US012011033B2

(12) United States Patent
Uthurry

(10) Patent No.: US 12,011,033 B2
(45) Date of Patent: Jun. 18, 2024

(54) MOUTHPIECE FOR AEROSOL-GENERATING DEVICE WITH WOVEN FIBER LINER

(71) Applicant: PHILIP MORRIS PRODUCTS S.A., Neuchatel (CH)

(72) Inventor: Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 555 days.

(21) Appl. No.: 17/278,475

(22) PCT Filed: Sep. 26, 2019

(86) PCT No.: PCT/EP2019/076015
§ 371 (c)(1),
(2) Date: Mar. 22, 2021

(87) PCT Pub. No.: WO2020/064921
PCT Pub. Date: Apr. 2, 2020

(65) Prior Publication Data

US 2022/0030938 A1 Feb. 3, 2022

(30) Foreign Application Priority Data

Sep. 27, 2018 (EP) ..... 18197186

(51) Int. Cl.
*A24F 40/485* (2020.01)
*A24D 3/17* (2020.01)
*A24F 40/42* (2020.01)

(52) U.S. Cl.
CPC ..... *A24D 3/17* (2020.01); *A24F 40/42* (2020.01); *A24F 40/485* (2020.01)

(58) Field of Classification Search
CPC ..... A24D 3/17; A24F 40/485; A24F 40/42; A24F 40/40; A24F 7/00; A24F 40/10
See application file for complete search history.

(56) References Cited

U.S. PATENT DOCUMENTS 10,104,911 B2 10/2018 Thorens
10,555,556 B2 2/2020 Batista
(Continued)

FOREIGN PATENT DOCUMENTS

CN 103237469 8/2013
CN 103974635 8/2014
(Continued)

OTHER PUBLICATIONS

Office Action issued in China for Application No. 201980058655.5 dated Jul. 5, 2022 (19 pages). English translation included.
(Continued)

*Primary Examiner* — Tho D Ta
(74) *Attorney, Agent, or Firm* — Mueting Raasch Group

(57) ABSTRACT

The invention relates to a mouthpiece (10) for an aerosol-generating device. The mouthpiece (10) comprises an inlet portion (12) configured for receiving an aerosol and an outlet portion (14) configured for outflow of the aerosol. An airflow path (16) connects the inlet portion (12) and the outlet portion (14). The airflow path (16) comprises an inner wall (18). The inner wall (18) of the airflow path (16) is at least partially lined with a capillary material (20). The capillarity of the capillary material (20) increases towards the inlet portion (12).

10 Claims, 4 Drawing Sheets

(56) References Cited

U.S. PATENT DOCUMENTS

Figure 1:
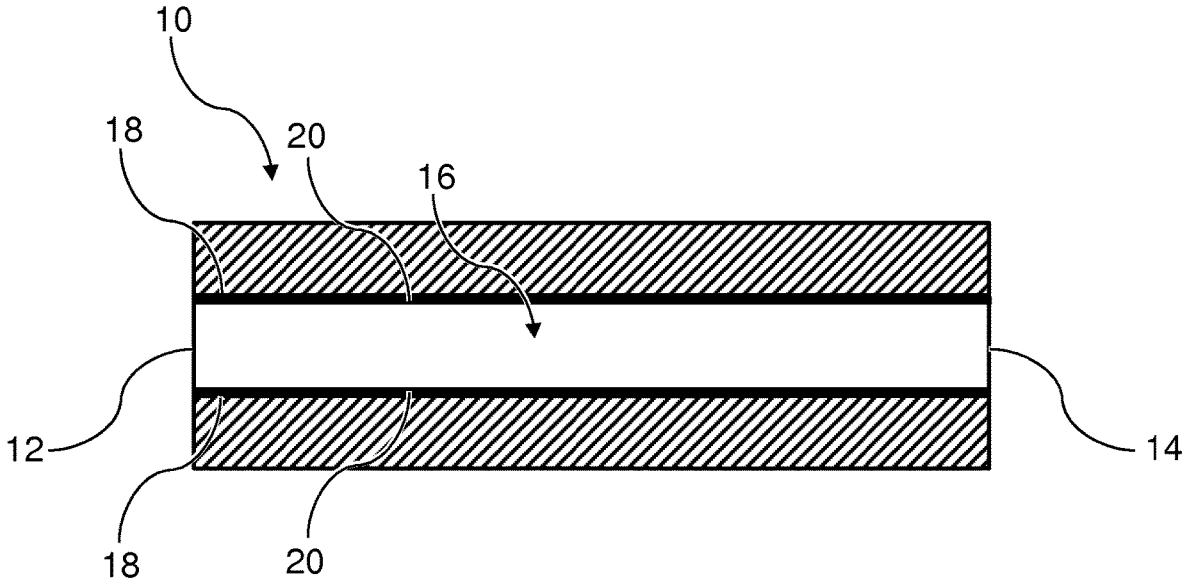

| | | | | |
|---|---|---|---|---|
| 2009/0272379 | A1 | 11/2009 | Thorens | |
| 2011/0226236 | A1 | 9/2011 | Buchberger | |
| 2013/0306064 | A1* | 11/2013 | Thorens | A61M 11/042 128/202.21 |
| 2013/0306065 | A1* | 11/2013 | Thorens | A24F 40/40 128/202.21 |
| 2014/0299137 | A1* | 10/2014 | Kieckbusch | A24F 40/51 131/328 |
| 2015/0208952 | A1 | 7/2015 | Addison | |
| 2015/0251201 | A1 | 9/2015 | Hradetzky | |
| 2016/0353802 | A1 | 12/2016 | Malgat | |
| 2017/0112197 | A1* | 4/2017 | Li | A24D 3/048 |
| 2017/0233114 | A1* | 8/2017 | Christensen | B65B 3/14 141/2 |
| 2017/0273360 | A1 | 9/2017 | Brinkley | |
| 2017/0281883 | A1* | 10/2017 | Li | A61M 11/042 |
| 2018/0028993 | A1 | 2/2018 | Dubief | |
| 2018/0064169 | A1 | 3/2018 | Biel | |

FOREIGN PATENT DOCUMENTS

| | | |
|---|---|---|
| RU | 2666102 | 9/2018 |
| RU | 2666670 | 9/2018 |

OTHER PUBLICATIONS

Office Action issued in Japan for Application No. 2021-514018 dated May 18, 2022 (12 pages). English translation included.
U.S. Appl. No. 10/021,915, filed Jul. 17, 2018, Cadieux.
Office Action issued in Russia for Application No. 2011/09944/03 dated Aug. 27, 2021 (6 pages). English translation included.
Search Report and Written Opinion for PCT/EP2019/076015 dated Dec. 6, 2019 (13 pages).
International Preliminary Examination Report on Patentability for PCT/EP2019/076015 dated Sep. 29, 2020 (10 pages).
Office Action issued in Korea for Application No. 10-2021-7006615 dated May 10, 2023 (10 pages). English translation included.

* cited by examiner

MOUTHPIECE FOR AEROSOL-GENERATING DEVICE WITH WOVEN FIBER LINER

This application is a U.S. National Stage Application of International Application No. PCT/EP2019/076015 filed Sep. 26, 2019, which was published in English on Apr. 2, 2020 as International Publication No. WO 2020/064921 A1. International Application No. PCT/EP2019/076015 claims priority to European Application No. 18197186.2 filed Sep. 27, 2018.

The present invention relates to a mouthpiece for an aerosol-generating device, to an aerosol-generating device comprising a mouthpiece and to a method for manufacturing a mouthpiece for an aerosol-generating device.

Aerosol-generating devices are known in which liquid aerosol-forming substrate is vaporized to generate an inhalable aerosol. The liquid aerosol-forming substrate is supplied from a liquid storage portion towards a heater element arranged in or around a heating chamber. The generated aerosol is drawn towards a user through a mouthpiece. During passage of the aerosol through the mouthpiece, liquid droplets may form due to condensation and adhere to the inner wall of the mouthpiece. This condensed liquid may leak from the mouthpiece and come into contact with the user's lips. Liquid contacting the user's lips may be unpleasant for the user and thus undesirable. Additionally, condensed aerosol negatively impairs the efficiency of the device, since more liquid aerosol-forming substrate must be vaporized to achieve the desired aerosol density reaching the user.

It would be desirable to have a mouthpiece for an aerosol-generating device which reduces or eliminates leakage of condensed aerosol and which increases efficiency of the device.

According to a first aspect of the invention there is provided a mouthpiece for an aerosol-generating device. The mouthpiece comprises an inlet portion configured for receiving an aerosol and an outlet portion configured for outflow of the aerosol. An airflow path connects the inlet portion and the outlet portion. The airflow path comprises an inner wall. The inner wall of the airflow path is at least partially lined with a capillary material. The capillarity of the capillary material increases towards the inlet portion.

Lining the inner wall of the airflow path with capillary material may mean that the capillary material is arranged adjacent and in contact with the inner wall of the airflow path. The capillary material may follow the shape of the inner wall of the airflow path so that the shape of the airflow path is not changed by the presence of the capillary material apart form a small diameter decrease due to the presence of the capillary material. The capillary material may be arranged lining the inner wall of the airflow path like a skin.

The term 'capillarity' may denote the ability of the capillary material to transport liquid, preferably liquid aerosol-forming substrate by capillary action. The capillary material may have a fibrous or spongy structure. The capillary material preferably comprises a bundle of capillaries. For example, the capillary material may comprise a plurality of fibres or threads or other fine bore tubes. The fibres or threads may be generally aligned to convey liquid towards the inlet portion. Alternatively, the capillary material may comprise sponge-like or foam-like material. The structure of the capillary material may form a plurality of small bores or tubes, through which the liquid can be transported by capillary action. The capillary material may comprise any suitable material or combination of materials. Examples of suitable materials are a sponge or foam material, ceramic- or graphite-based materials in the form of fibres or sintered powders, foamed metal or plastics materials, a fibrous material, for example made of spun or extruded fibres, such as cellulose acetate, polyester, or bonded polyolefin, polyethylene, ethylene or polypropylene fibres, nylon fibres or ceramic. Generally, the capillary material may be made of one or more of ceramic, carbon, fabric or plastic. The capillary material may have any suitable capillarity and porosity so as to be used with different liquid physical properties.

Increasing capillarity of the capillary material may be achieved by compressing the capillary material in the direction of the inlet portion of the mouthpiece. Capillarity of the capillary material may also be increased by increasing density of the capillary material. Density of the capillary material may be increased by compressing the capillary material or by the material properties itself. Alternatively or additionally, at least two capillary materials may be provided adjacent to each other and in fluid connection with each other. The capillary materials may be arranged along the longitudinal axis of the mouthpiece. The individual capillarities of the materials may increase towards the inlet portion of the mouthpiece, for example by one or more of the density of the materials or by using different materials. Particularly preferred is an embodiment in which the capillary material is provided as a single woven fiber tube for optimally lining the inner wall of the airflow channel. The liquid has physical properties, including but not limited to viscosity, surface tension, density, thermal conductivity, boiling point and vapour pressure, which allow the liquid to be transported through the capillary material by capillary action. The capillary material may be configured to convey aerosol-forming substrate towards the inlet portion.

By lining the inner wall of the airflow channel with the capillary material, leakage of condensed aerosol may be prevented. In this regard, aerosol entering the mouthpiece at the inlet portion of the mouthpiece may cool down during passage through the mouthpiece. The cooling of the aerosol may result in condensation and thus formation of liquid droplets. These droplets may be desirable to a certain degree. However, droplets may come into contact with the inner wall of the airflow channel and stick to the inner wall. These droplets may accumulate and at some point leak out of the outlet portion of the mouthpiece. The capillary material prevents the droplets from leaking out of the outlet portion by entraining droplets coming into contact with the inner wall. Additionally, the capillary material prevents droplet accumulation on the inner wall of the airflow channel.

Additionally, the capillary material of the present invention has an increasing capillary towards the inlet portion of the mouthpiece. A higher capillarity means that the capillary forces acting on a liquid is increased. Thus, in the present invention liquid droplets entrained by the capillary material may predominantly flow towards the inlet portion by capillary forces. This aspect of the present invention may further aid in preventing leakage of liquid aerosol-forming substrate from the outlet portion of the mouthpiece. In addition, the mouthpiece may be attached or attachable to a main body of an aerosol-generating device as described in more detail below. The aerosol-generating device may comprise a heating chamber and an atomizer adjacent the inlet portion of the mouthpiece for aerosol generating. By channeling liquid aerosol-forming substrate back towards the inlet portion of the mouthpiece and towards the heating chamber of the aerosol-generating device, the aerosol-forming substrate may be vaporized again for aerosol generation thereby increasing efficiency. If the mouthpiece is attached to the main body, particularly permanently attached, the capillary material may reach into the heating chamber for wicking the entrained liquid aerosol-forming substrate close to the atomizer.

Even before being wicked towards the inlet portion of the mouthpiece by the capillary material, condensed liquid may be aerosolized again. In this regard, the surface energy of the capillary material may be increased, preferably by a surface energy increasing coating. An increased surface energy of the capillary material may increase the wettability and the adhesion of the liquid to the surface of the capillary material. The surface tension of the liquid may be reduced, which may lower the required aerosolization energy. This may aid in holding condensed liquid. Also, the decreased surface tension may bring the condensed liquid to its point of aerosolization so that more aerosol may leave the mouthpiece through the outlet portion of the mouthpiece.

By providing the capillary material as a woven fiber tube, entrainment of condensed aerosol may be enhanced by increasing the surface of the capillary material coming into contact with the aerosol. The woven fiber tube may also be denoted as woven fiber liner. The woven fiber tube may be replaced with a fiber tube or fiber liner which is not woven. The increased surface of the capillary material may increase the capillary action towards the inlet portion of the mouthpiece. Also, lining the inner wall of the airflow channel with the capillary material is simplified by using a woven fiber tube as capillary material.

The fiber density of the woven fiber tube may increase towards the inlet portion. By increasing the fiber density, capillarity of the capillary material may be increased. The fiber density may be increased by compressing the capillary material towards the inlet portion of the mouthpiece. Alternatively or additionally, the fiber density of the capillary material may be increased by providing at least two capillary materials adjacent to each other along the longitudinal axis of the mouthpiece, wherein the capillary material arranged closer to the inlet portion of the mouthpiece has as higher fiber density than the capillary material closer to the outlet portion of the mouthpiece.

The capillary material may line the full circumference of the inner wall of the airflow path. The surface of the capillary material may be maximized by lining the full circumference of the inner wall of the airflow path. Hence, capillary action transporting condensed liquid towards the inlet portion of the mouthpiece may be enhanced and condensation leakage may be minimized.

The diameter of the airflow path at the outlet portion may be greater than the diameter of the airflow path at the inlet portion. This shape of the airflow path may minimize condensed aerosol coming into contact with the inner wall of the airflow path. To achieve this shape of the airflow, the capillary material adjacent to the inlet portion may be compressed in radial direction more than that adjacent to the outlet portion by providing the inlet portion with a diameter which is less than the diameter of the outlet portion so that the thickness of the capillary material decreases towards upstream. This may lead to increased capillarity of the capillary material in the direction of the inlet portion. Flow on liquid aerosol-forming substrate in the direction of the inlet portion of the mouthpiece by capillary action may thus be optimized. As a particular example, the airflow path may have a conical shape, wherein the diameter of the airflow path at the outlet portion may be larger than the diameter of the airflow path at the inlet portion.

The capillary material may be configured as a coating coated onto the inner wall of the airflow path. Providing the capillary material as a coating may simplify application of the capillary material. Also, the inner wall of the airflow channel may be uniformly lined with the capillary material.

A surface energy increasing coating as described above may be provided on the inner wall of the airflow path or the capillary material or both. A surface energy increasing coating applied on the inner wall of the airflow channel, particularly on the capillary material, may increase entrainment of condensed aerosol. Then, the condensed aerosol may be conveyed towards the inlet portion of the mouthpiece by capillary action.

The aerosol-forming substrate is a substrate capable of releasing volatile compounds that can form an aerosol. The volatile compounds may be released by heating the aerosol-forming substrate. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The aerosol-former may be propylene glycol. The aerosol former may comprise both glycerine and propylene glycol.

The liquid aerosol-forming substrate may comprise other additives and ingredients, such as flavourants. The liquid aerosol-forming substrate may comprise water, solvents, ethanol, plant extracts and natural or artificial flavours. The liquid aerosol-forming substrate may comprise nicotine. The liquid aerosol-forming substrate may have a nicotine concentration of between about 0.5% and about 10%, for example about 2%.

The present invention also relates to an aerosol-generating device, wherein the aerosol-generating device comprises:

- a main body comprising:
  - an air inlet configured to allow ambient air to be drawn into the device,
  - a liquid storage portion for storing liquid aerosol-forming substrate, and
  - a heating chamber with an atomizer for generating an inhalable aerosol,
- a mouthpiece according to any one of the preceding claims, wherein the mouthpiece is configured attached or attachable to the main body.

As used herein, an 'aerosol-generating device' relates to a device that interacts with an aerosol-forming substrate to generate an aerosol. An aerosol-generating device may be a smoking device that interacts with an aerosol-forming substrate to generate an aerosol that is directly inhalable into a user's lungs thorough the user's mouth. The device may be an electrically heated smoking device.

The device is preferably a portable or handheld device that is comfortable for a user to hold between the fingers of a single hand. The device may be substantially cylindrical in shape and has a length of between 70 and 120 mm. The maximum diameter of the device is preferably between 10 and 20 mm. In one embodiment the device has a polygonal cross section and has a protruding button formed on one face. In this embodiment, the diameter of the device is between 12.7 and 13.65 mm taken from a flat face to an opposing flat face; between 13.4 and 14.2 taken from an edge to an opposing edge (i.e., from the intersection of two faces on one side of the device to a corresponding intersection on the other side), and between 14.2 and 15 mm taken from a top of the button to an opposing bottom flat face.

The atomizer of the aerosol-generating device is provided to atomize the liquid aerosol-forming substrate to form an aerosol, which can subsequently be inhaled by a user. The atomizer may comprise a heating element, in which case the atomizer will be denoted as a vaporiser. Generally, the atomizer may be configured as any device which is able to atomize the liquid aerosol-forming substrate. For example, the atomizer may comprise a nebulizer or an atomizer nozzle based on the Venturi effect to atomize the liquid aerosol-forming substrate. Thus, the atomization of the liquid aerosol-forming substrate may be realized by a non-thermally aerosolization technique. A mechanically vibrating vaporiser with vibrating elements, vibrating meshes, a piezo-driven nebulizer or surface acoustic wave aerosolization may be used.

Preferably, the atomizer is configured as a vaporiser comprising a heater for heating the supplied amount of liquid aerosol-forming substrate. The heater may be any device suitable for heating the liquid aerosol-forming substrate and vaporize at least a part of the liquid aerosol-forming substrate in order to form an aerosol. The heater may exemplarily be a coil heater, a capillary tube heater, a mesh heater or a metal plate heater. The heater may exemplarily be a resistive heater which receives electrical power and transforms at least part of the received electrical power into heat energy. Alternatively, or in addition, the heater may be a susceptor that is inductively heated by a time varying magnetic field. The heater may comprise only a single heating element or a plurality of heating elements. The temperature of the heating element or elements is preferably controlled by electric circuitry.

The at least one heater preferably comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

For controlling operation of the vaporiser, the aerosol-generating device may comprise electric circuitry, which may comprise a microprocessor such as a programmable microprocessor. The microprocessor may be part of a controller. The electric circuitry may comprise further electronic components. The electric circuitry may be configured to regulate a supply of power to the vaporiser. Power may be supplied to the vaporiser continuously following activation of the device or may be supplied intermittently, such as on a puff-by-puff basis. The power may be supplied to the vaporiser in the form of pulses of electrical current. The electric circuitry may be configured to monitor the electrical resistance of the vaporiser, and preferably to control the supply of power to the vaporiser dependent on the electrical resistance of the vaporiser.

The device may comprise a power supply, typically a battery, within the main body. As an alternative, the power supply may be another form of charge storage device such as a capacitor. The power supply may require recharging and may have a capacity that enables to store enough energy for one or more smoking experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heater.

A wall of the housing of the aerosol-generating device, preferably a wall opposite the vaporiser, preferably a bottom wall, is provided with at least one semi-open inlet. The semi-open inlet preferably allows air to enter the aerosol-generating device. Air or liquid may be prevented from leaving the aerosol-generating device through the semi-open inlet. The semi-open inlet may for example be a semi-permeable membrane, permeable in one direction only for air, but is air- and liquid-tight in the opposite direction. The semi-open inlet may for example also be a one-way valve. Preferably, the semi-open inlets allow air to pass through the inlet only if specific conditions are met, for example a minimum depression in the aerosol-generating device or a volume of air passing through the valve or membrane.

Operation of the vaporiser may be triggered by a puff detection system. Alternatively, the vaporiser may be triggered by pressing an on-off button, held for the duration of the user's puff. The puff detection system may be provided as a sensor, which may be configured as an airflow sensor to measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Initiation may also be detected upon a user activating a button.

The sensor may also be configured as a pressure sensor to measure the pressure of the air inside the aerosol-generating device which is drawn through the airflow path of the device by the user during a puff. The sensor may be configured to measure a pressure difference or pressure drop between the pressure of ambient air outside of the aerosol-generating device and of the air which is drawn through the device by the user. The pressure of the air may be detected at the air inlet, the mouthpiece of the device, the heating chamber or any other passage or chamber within the aerosol-generating device, through which the air flows. When the user draws on the aerosol-generating device, a negative pressure or vacuum is generated inside the device, wherein the negative pressure may be detected by the pressure sensor. The term "negative pressure" is to be understood as a pressure which is relatively lower than the pressure of ambient air. In other words, when the user draws on the device, the air which is drawn through the device has a pressure which is lower than the pressure off ambient air outside of the device. The initiation of the puff may be detected by the pressure sensor if the pressure difference exceeds a predetermined threshold.

The aerosol-forming substrate may be stored in a liquid storage portion arranged in the main body of the aerosol-generating device. The liquid storage portion may be any suitable shape and size. For example, the liquid storage portion may be substantially cylindrical. The cross-section of the liquid storage portion may, for example, be substantially circular, elliptical, square or rectangular.

The liquid storage portion may comprise a housing. The housing may comprise a base and one or more sidewalls extending from the base. The base and the one or more sidewalls may be integrally formed. The base and one or more sidewalls may be distinct elements that are attached or secured to each other. The housing may be a rigid housing. As used herein, the term 'rigid housing' is used to mean a housing that is self-supporting. The rigid housing of the liquid storage portion may provide mechanical support to the aerosol-generating means. The liquid storage portion may comprise one or more flexible walls. The flexible walls may be configured to adapt to the volume of the liquid aerosol-forming substrate stored in the liquid storage portion. The housing of the liquid storage portion may comprise any suitable material. The liquid storage portion may comprise substantially fluid impermeable material. The housing of the liquid storage portion may comprise a transparent or a translucent portion, such that liquid aerosol-forming substrate stored in the liquid storage portion may be visible to a user through the housing. The liquid storage portion may be configured such that aerosol-forming substrate stored in the liquid storage portion is protected from ambient air. The liquid storage portion may be configured such that aerosol-forming substrate stored in the liquid storage portion is protected from light. This may reduce the risk of degradation of the substrate and may maintain a high level of hygiene.

The liquid storage portion may be substantially sealed. The liquid storage portion may comprise one or more outlets for liquid aerosol-forming substrate stored in the liquid storage portion to flow from the liquid storage portion to the aerosol-generating device. The liquid storage portion may comprise one or more semi-open inlets. This may enable ambient air to enter the liquid storage portion. The one or more semi-open inlets may be semi-permeable membranes or one-way valves, permeable to allow ambient air into the liquid storage portion and impermeable to substantially prevent air and liquid inside the liquid storage portion from leaving the liquid storage portion. The one or more semi-open inlets may enable air to pass into the liquid storage portion under specific conditions. The liquid storage portion may be arranged permanently in the main body of the aerosol-generating device. The liquid storage portion may be refillable. Alternatively, the liquid storage portion may be configured as a replaceable liquid storage portion. The liquid storage portion may be part of or configured as a replaceable cartridge. The aerosol-generating device may be configured for receiving the cartridge. A new cartridge may be attached to the aerosol-generating device when the initial cartridge is spent.

The present invention also relates to an aerosol-generating system comprising an aerosol-generating device according to the description above and a cartridge containing aerosol-forming substrate.

The present invention also relates to a method for manufacturing a mouthpiece for an aerosol-generating device, wherein the method comprises the following steps:

i. providing a mouthpiece comprising an inlet portion configured for receiving an aerosol, an outlet portion configured for outflow of the aerosol, and an airflow path connecting the inlet portion and the outlet portion, wherein the airflow path comprises an inner wall,
ii. at least partially lining the inner wall of the airflow path with a capillary material, wherein the capillarity of the capillary material increases towards the inlet portion.

Features described in relation to one aspect may equally be applied to other aspects of the invention.

Figure 2:
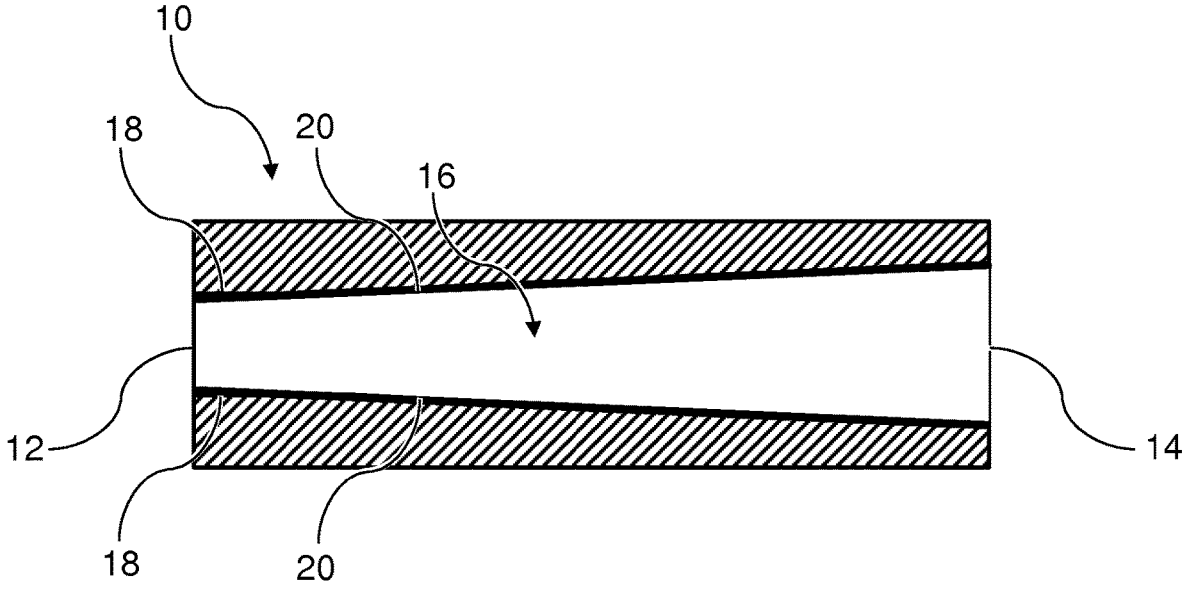
Figure 3:
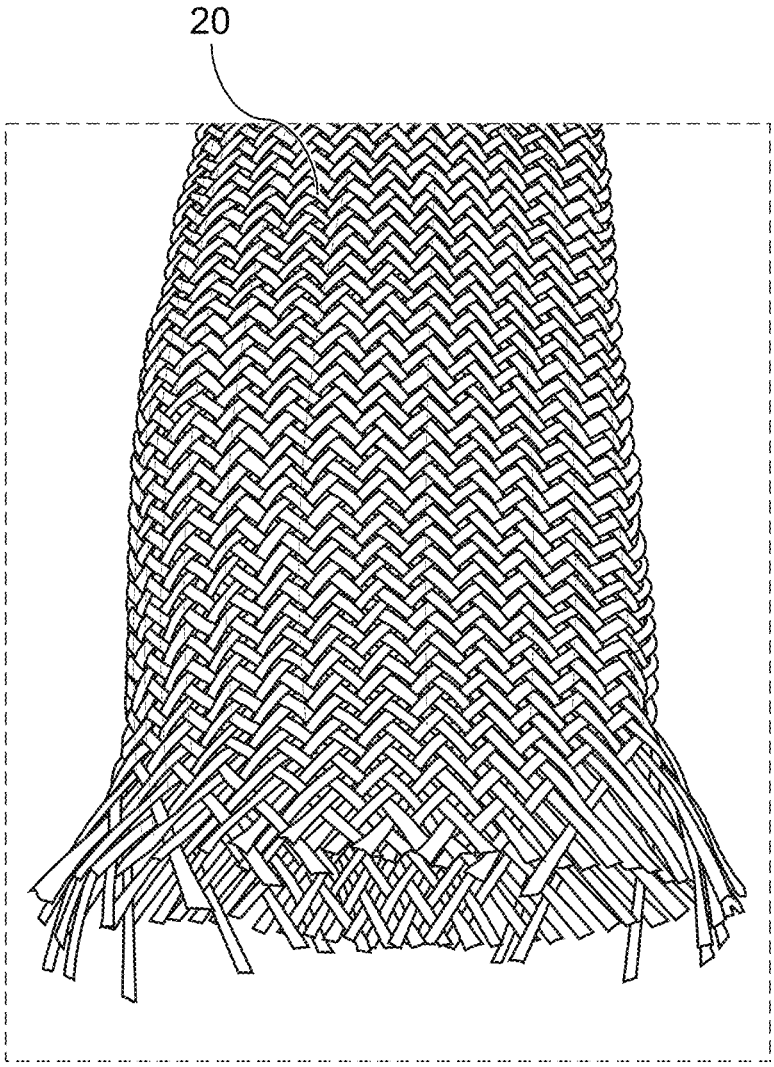
Figure 4:
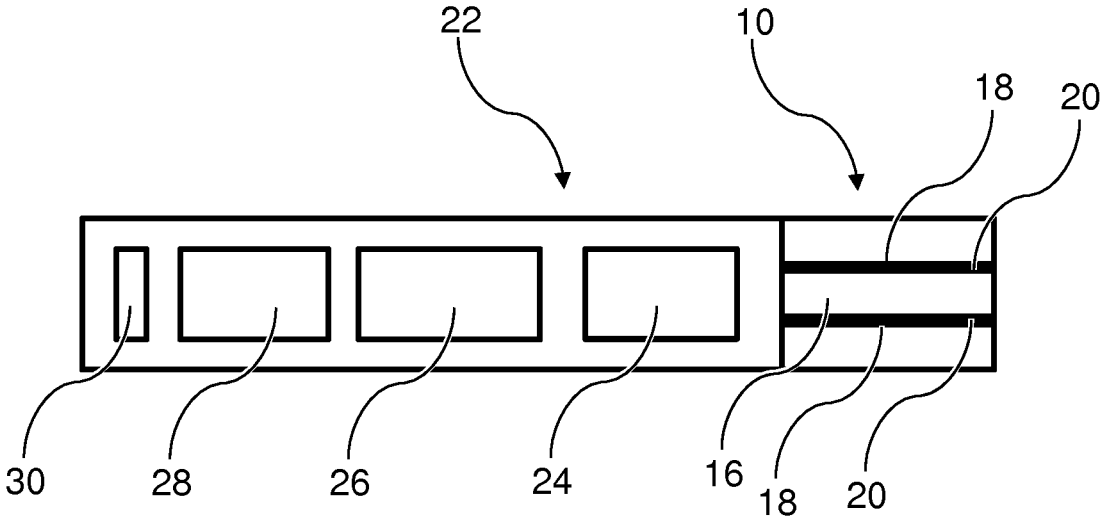

The invention will be further described, by way of example only, with reference to the accompanying drawings in which:

FIG. 1 shows an illustrative cross-sectional view of an embodiment of a mouthpiece according to the present invention, FIG. 2 shows an illustrative cross-sectional view of a further embodiment of the mouthpiece according to the present invention, FIG. 3 shows an illustrative view of a woven fiber tube used as capillary material in the mouthpiece according to the present invention, and FIG. 4 shows an illustrative cross-sectional view of an embodiment of an aerosol-generating device according to the present invention, FIG. 1 shows a mouthpiece 10 according to the present invention for an aerosol-generating device. The mouthpiece 10 comprises an inlet portion 12. The inlet portion 12 is configured to allow an aerosol to enter the mouthpiece 10. The inlet portion 12 is preferably configured as an opening for this purpose. The inlet portion 12 is arranged at an upstream or distal end of the mouthpiece 10. An outlet portion 14 is provided opposite the inlet portion 12. The outlet portion 14 may be a mouth-end of the mouthpiece 10, which may be in contact with the lips of a user for aerosol inhalation. The outlet portion 14 is configured to enable outflow of aerosol out of the mouthpiece 10. The outlet portion 14 is arranged at the downstream end of the mouthpiece 10. The outlet portion 14 is preferably arranged at the proximal end of the mouthpiece 10.

FIG. 1 further shows an airflow channel 16 arranged between the inlet portion 12 and the outlet portion 14. The airflow channel 16 allows airflow, particularly flow of aerosol, between the inlet portion 12 and the outlet portion 14. The airflow channel 16 in the embodiment shown in FIG. 1 has a hollow tubular shape. The cross-section of the airflow channel 16 is preferably circular. The airflow channel 16 thus preferably has a cylindrical shape. The airflow channel 16 has an inner wall 18 facing the inside of the airflow channel 16. The inner wall 18 is arranged around the longitudinal axis of the mouthpiece 10. The longitudinal axis of the mouthpiece 10 may be identical to the longitudinal axis of the airflow channel 16. The airflow channel 16 may also be offset with respect to the longitudinal axis of the mouthpiece 10.

The inner wall 18 of the airflow channel 16 is lined with capillary material 20. The capillary material 20 shown in FIG. 1 lines the complete circumference of the airflow channel 16. In other words, the whole inner wall 18 of the airflow channel is lined with the capillary material 20 in the embodiment shown in FIG. 1. However, only parts of the inner wall 18 of the airflow channel 16 may be lined with the capillary material 20, if desirable. For example, it may not be necessary to line the whole inner wall 18 with capillary material 20 to achieve a desired degree of condensation entrainment. The capillary material 20 is configured to entrain liquid droplets formed in the aerosol passing through the airflow channel 16, which come into contact with the capillary material 20. The droplets may be soaked by the capillary material 20. In addition, the entrained liquid may be transported through the capillary material 20 by capillary action. The capillary material 20 is preferably provided as a woven fiber tube, which can be optimally inserted into the airflow channel 16 for lining the inner wall 18 of the airflow channel 16.

The capillarity of the capillary material 20 increases in the direction of the inlet portion 12. Thus, condensed liquid droplets of aerosol-forming substrate may be wicked by the capillary material 20 in the direction of the inlet portion 12. The increased capillarity of the capillary material 20 in the area of the inlet portion 12 may create a suction effect for liquid aerosol-forming substrate farther away from the inlet portion 12 so that the liquid is drawn towards the inlet portion 12.

FIG. 2 shows a further embodiment, in which the airflow channel 16 has a conical shape, with the airflow channel 16 tapering in the direction of the inlet portion 12. The conical shape of the airflow channel 16 may aid wicking of entrained liquid away from the outlet portion 14 to prevent leakage of the liquid. In this regard, the capillary material 20 lining the inner wall 18 of the airflow channel 16 adjacent to the inlet portion 12 may be compressed in radical direction more than that adjacent to the outlet portion 14 thereby increasing the density of the capillary material 20 towards the inlet portion 12. Increased density of the capillary material 20 may increase capillarity of the capillary material 20.

FIG. 3 shows an example of the capillary material 20 in the form of a woven fibre tube. The capillary material 20 is preferably inserted into the airflow channel 16 and may be treated to line the inner wall 18 of the airflow channel 16. Treatments such as heating the woven fiber tube after insertion into the airflow channel 16 may be employed to bond the woven fiber tube to the inner wall 18 of the airflow channel 16. The woven fiber tube may be flexible such that the woven fiber tube may adapt to the shape of the airflow channel 16. If the woven fiber tube is inserted into a conical airflow channel 16 as shown in FIG. 2, the woven fiber tube comprising the capillary material 20 will also have a conical shape. In this this case, the fiber density of the capillary material 20 will increase towards the inlet portion 12 thereby increasing capillarity towards the inlet portion 12.

FIG. 4 shows an aerosol-generating device with a mouthpiece 10 as described above and a main body 22. The mouthpiece 10 is attached or attachable to the main body 22. The main body 22 preferably comprises a heating chamber 24, wherein a vaporiser is arranged in or around the heating chamber 24 for generation of an inhalable aerosol. The liquid aerosol-forming substrate which is used in the heating chamber 24 for aerosol generation may be stored in a liquid storage portion 26. The liquid storage portion 26 may be fixed to the main body 22 permanently or provided as a replaceable cartridge.

FIG. 4 also shows a power supply 28 such as a battery for powering the vaporiser. Electric circuitry 30 may control supply of electrical energy from the power supply 28 towards the vaporiser. An air inlet which is not shown in FIG. 4 allows ambient air to enter the device. The air flows from the air inlet towards the heating chamber 24 for aerosol generation. After the aerosol has been generated, the aerosol flows into the mouthpiece 10 by means of the inlet portion 12 of the mouthpiece 10. The aerosol continues to pass through the airflow channel 16 of the mouthpiece 10 and towards the outlet portion 14 of the mouthpiece for inhalation by a user. As described above, leakage of condensed aerosol-forming substrate is prevented by lining the inner wall 18 of the airflow channel 16 with capillary material 20. In addition, the capillary material 20 has a higher capillarity in the direction of the inlet portion 12 so that condensed liquid entrained by the capillary material 20 is predominantly wicked towards the inlet portion 12 by capillary action. This configuration of the capillary material 20 not only enhances leakage prevention of the condensed aerosol. This configuration of the capillary material 20 also enables channeling of the liquid aerosol-forming substrate back towards the heating chamber 24 of the aerosol-generating device. The condensed substrate may then be vaporized again in the heating chamber 24 so that usage of the aerosol-generating substrate is optimized.

The invention claimed is:

1. A mouthpiece for an aerosol-generating device, wherein the mouthpiece comprises:

an inlet portion configured for receiving an aerosol, an outlet portion configured for outflow of the aerosol, and an airflow path connecting the inlet portion and the outlet portion, wherein the airflow path comprises an inner wall, wherein the inner wall of the airflow path is at least partially lined with a capillary material, wherein the capillarity of the capillary material increases towards the inlet portion and wherein the capillary material is a woven fiber tube.

2. The mouthpiece according to claim 1, wherein the fiber density of the woven fiber tube increases towards the inlet portion.

3. The mouthpiece according to claim 1, wherein the capillary material lines the full circumference of the inner wall of the airflow path.

4. The mouthpiece according to claim 1, wherein the diameter of the airflow path at the outlet portion is greater than the diameter of the airflow path at the inlet portion.

5. The mouthpiece according to claim 1, wherein the airflow path has a conical shape, and wherein the diameter of the airflow path at the outlet portion is greater than the diameter of the airflow path at the inlet portion.

6. The mouthpiece according to claim 1, wherein the capillary material is configured as a coating coated onto the inner wall of the airflow path.

7. The mouthpiece according to claim 1, wherein a surface energy increasing coating is provided on the inner wall of the airflow path or the capillary material or the inner wall of the airflow path and the capillary material.

8. The mouthpiece according to claim 1, wherein the capillary material is made of one or more of ceramic, carbon, fabric or plastic.

9. An aerosol-generating device, wherein the aerosol-generating device comprises:

a main body comprising:

an air inlet configured to allow ambient air to be drawn into the device, a liquid storage portion for holding liquid aerosol-forming substrate, and a heating chamber with an atomizer for generating an inhalable aerosol, a mouthpiece according to claim 1, wherein the mouthpiece is configured attached or attachable to the main body.

10. A method for manufacturing a mouthpiece for an aerosol-generating device, wherein the method comprises the following steps:

i. providing a mouthpiece comprising an inlet portion configured for receiving an aerosol, an outlet portion configured for outflow of the, and an airflow path connecting the inlet portion and the outlet portion, wherein the airflow path comprises an inner wall, ii. at least partially lining the inner wall of the airflow path with a capillary material, wherein the capillarity of the capillary material increases towards the inlet portion and wherein the capillary material is a woven fiber tube.

* * * * *